US007995776B2

(12) United States Patent
Greubel et al.

(10) Patent No.: US 7,995,776 B2
(45) Date of Patent: Aug. 9, 2011

(54) TIMEPIECE WITH SOUND GENERATOR

(75) Inventors: Robert Alain Greubel, Lignières (CH); Stephen Edward Methuen Forsey, Le Locle (CH); Ludovic Philippe Roland Perez, Villers-le-Lac (FR)

(73) Assignee: Lange Uhren GmbH, Glashuette (DE)

( * ) Notice: Subject to any disclaimer, the term of this patent is extended or adjusted under 35 U.S.C. 154(b) by 1183 days.

(21) Appl. No.: 11/634,670

(22) Filed: Dec. 6, 2006

(65) Prior Publication Data

US 2007/0140067 A1 Jun. 21, 2007

(30) Foreign Application Priority Data

Dec. 7, 2005 (DE) ..... 10 2005 058 322

(51) Int. Cl.
*H04R 25/00* (2006.01)

(52) U.S. Cl. ..... 381/162; 381/334; 381/336; 381/365

(58) Field of Classification Search ..... 381/162, 381/306, 333, 334, 336, 365, 384, 388; 368/73, 368/255; 181/160
See application file for complete search history.

(56) References Cited

U.S. PATENT DOCUMENTS

| | | | | |
|---|---|---|---|---|
| 384,412 A | | 6/1888 | Bapst et al. | |
| 2,644,294 A | | 7/1953 | Ditisheim | |
| 3,879,931 A | | 4/1975 | Yasuda et al. | |
| 4,068,461 A | * | 1/1978 | Fassett et al. | 368/73 |
| 4,216,650 A | | 8/1980 | Hara et al. | |
| 4,250,573 A | * | 2/1981 | Saito | 368/73 |

FOREIGN PATENT DOCUMENTS

| | | |
|---|---|---|
| CH | 323231 | 8/1957 |
| CH | 324394 | 10/1957 |
| DE | 920 958 | 12/1954 |
| DE | 902 479 | 3/1957 |

OTHER PUBLICATIONS

European Search Report dated May 21, 2008 for corresponding European application 06022988.7-1240.
Examination Report dated Jan. 12, 2007 issued for the corresponding German Application No. 10 2005 058 322.9-31.

* cited by examiner

*Primary Examiner* — Suhan Ni
(74) *Attorney, Agent, or Firm* — Cohen Pontani Lieberman & Pavane LLP

(57) ABSTRACT

A timepiece includes a casing having a casing interior having a viewer's side provided with a viewing opening, a base side provided with a sound aperture, and an annular surface surrounding the sound aperture. A membrane extending over the sound aperture closes the base side of the casing interior, the membrane having a circumferential region in sealed connection with the annular surface. A tensioning device maintains the membrane at a desired tension in the radial direction. A vibration generator arranged in the casing interior produces a sound whose frequency can be adjusted by adjusting the tension of the membrane.

21 Claims, 3 Drawing Sheets

TIMEPIECE WITH SOUND GENERATOR

BACKGROUND OF THE INVENTION

1. Field of the Invention

The invention relates to a timepiece, in particular a wristwatch, having a casing with an interior which has, on the viewer's side, an opening closed by a cover glass and, on the base side, a sound aperture which is closed by a membrane having a circumferential region in sealed connection with a corresponding annular surface of the casing. A vibration generator arranged in the casing interior can generate sound vibrations.

2. Description of the Related Art

In the case of such timepieces, the membrane ensures that the casing interior, in which the movement and the vibration generator are located, is closed in the outward direction in order to prevent the ingress of dirt and moisture.

At the same time, the ability of the membrane to vibrate is intended to ensure good transmission in the outward direction of the sound vibrations generated by the vibration generator.

However, this transmission of the sound vibrations in the outward direction only takes place optimally when the frequency of the sound vibrations generated by the vibration generator and the characteristic frequency of the membrane are equal.

SUMMARY OF THE INVENTION

The object of the invention is thus to provide a timepiece of the type mentioned in the introduction in which transmission of the sound vibrations of the vibration generator in the outward direction is optimized.

According to the invention, the membrane can be subjected to tensile loading in the radially outward direction by a tensioning device.

This design makes it possible to change the stressing of the membrane and thus to adjust the characteristic frequency of the membrane to the frequency of the sound vibrations generated by the vibration generator. These sound vibrations can thus be transmitted in the outward direction from the casing interior in an optimized manner, so that the brilliance of the sound vibrations generated, as far as possible, is not adversely affected during the transmission in the outward direction.

It is likewise possible to compensate for tolerance-induced fluctuations in the sound vibrations of the vibration generator.

Tensile loading is easily possible if the radially encircling periphery of the membrane is connected in a sealed manner to a clamping ring which can be subjected to tensile loading in the radially outward direction by the tensioning means, the radially encircling periphery of the membrane preferably being connected to the clamping ring by a non-releasable connection.

If the membrane is connected to the clamping ring with a certain level of radial prestressing, it is then possible, in the first instance, for the membrane to be easily connected to the clamping ring with a certain level of basic stressing and thus a certain characteristic frequency, prior to precision adjustment subsequently taking place by the tensioning device.

A sealed and fixed connection between the membrane and the clamping ring is possible by the membrane being connected to the clamping ring by soldering or welding, in particular by laser welding.

Laser welding here has the additional advantage that thermal loading takes place only in the immediate welding region, but not in the freely clamped region, of the membrane, this latter region determining the characteristic frequency.

This avoids any thermally induced change in the characteristic frequency of the membrane.

Another sealed and fixed connection between the membrane and the clamping ring, while avoiding thermal influencing of the membrane, is brought about by the membrane being connected to the clamping ring by adhesive bonding.

It is also possible, however, for the membrane to be clamped in between two clamping-ring parts which can be connected to one another, and are preferably clamped axially in relation to one another by screws.

In order to seal the region of connection between the membrane or the clamping ring and the casing, it is possible for a groove, which is formed in a radially encircling manner in the annular surface, to contain a sealing ring, against which the membrane or the clamping ring butts axially.

In order for the clamping ring to act firmly on the annular surface and to be fixed, the clamping ring can be clamped against the annular surface by means of clamping screws, which can be screwed into axial threaded bores of the casing and have their screw head bearing on the clamping ring.

For uniform abutment here, the clamping screws are preferably distributed uniformly around the clamping ring.

The tensioning means may be embodied by the clamping ring containing radially directed threaded bores which open out in the radially outward direction and into which it is possible to screw tensioning screws, which can be supported on the casing against moving radially inwards.

Adjustment of the characteristic frequency of the membrane can thus take place in the state in which the latter is installed in the casing, so that it is not possible for installation-induced changes in the characteristic frequency of the membrane to take place.

In a straightforward embodiment here, the tensioning screws are arranged in stepped bores which are coaxial with the threaded bores and of which the large step opens out in the radially outward direction, the tensioning screw having its screw head supported on the transition between the large step and the small step.

With a further possible tensioning device, the membrane can be subjected to axial adjustment by a clamping element in its radially outer peripheral region. The clamping element is a clamping ring which acts on the membrane axially in its radially outer encircling peripheral region, which allows the membrane to be subjected to uniform radially encircling action.

For straightforward adjustment of the clamping ring, the clamping element can be adjusted axially by means of adjusting screws.

In order to protect the membrane against damage and in order for the sound vibrations to pass outwards to simultaneous good effect, the membrane is preferably covered by a casing base which can be fastened on the casing. A space from which sound-outlet openings lead outwards, in particular in the radial direction, is formed between the membrane and casing base.

A clear amplification of the outwardly emitted sound of the sound vibrations is achieved if the space and the sound-outlet openings form a Helmholtz resonator.

The membrane is preferably a metal membrane, and this may, where possible, consist of a corrosion-resistant material, in particular of gold or of a gold alloy.

A good spectrum of sound vibrations can be achieved by the vibration generator being a gong or a bell which can be struck by a hammer, the gong or bell preferably consisting of a metal.

Particularly good sound properties can be achieved here when the vibration generator consists of niobium (Nb) or of a niobium (Nb)-containing alloy.

Exemplary embodiments of the invention are described in more detail hereinbelow and illustrated in the drawing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
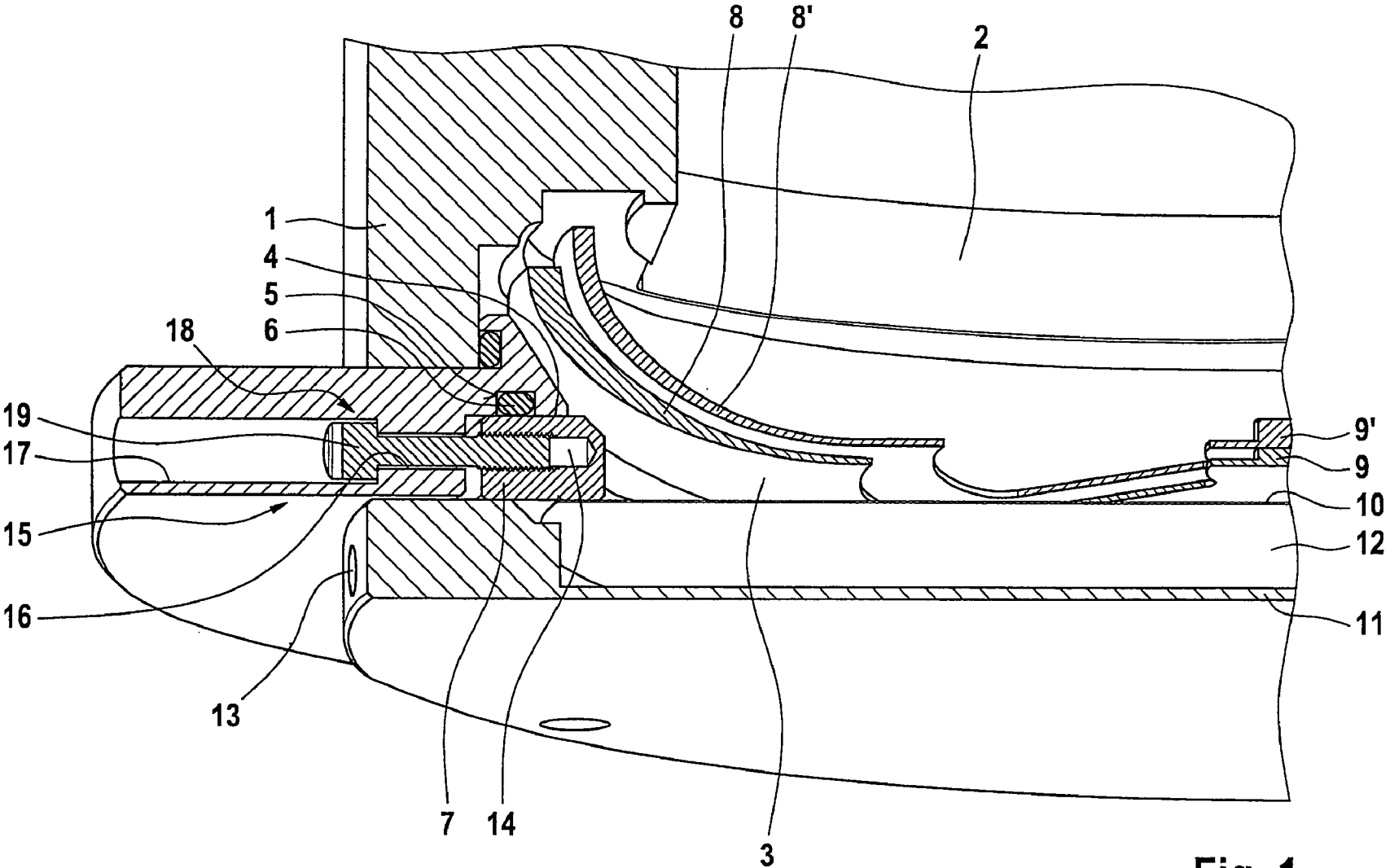
FIG. 1 shows a partial cross-sectional view of a first exemplary embodiment of a timepiece.

Those details of a timepiece which are illustrated in the figures show a timepiece casing 1, of which the casing interior 2 has a sound aperture 3 which is closed by a metallic membrane 10.

An annular surface 4 is arranged on the casing 1 around the sound aperture 3. This surface extends radially in relation to the sound aperture 3 and has a circular groove 5 formed in it. The groove 5 contains a sealing ring 6 which projects part of the way out of the groove 5.

A clamping ring 7, 7' of approximately rectangular cross section bears firmly on the annular surface and the sealing ring 6.

On that side of the clamping ring 7, 7' which is directed away from the annular surface 4, the membrane 10 is fastened by laser welding and covers the opening of the clamping ring 7, 7'.

Arranged centrally within the casing interior 2 are two bells 8, 8' of a vibration generator, which can be struck by a hammer (not illustrated) in order to generate sound vibrations.

The bells 8, 8' are arranged coaxially with one another and have central retaining elements 9 for fastening (not illustrated) in the casing 1.

The membrane 10 is covered in the outward direction by a cup-like casing base 11 which is connected to the casing 1, a space 12 from which sound-outlet openings 13 lead outwards in the radial direction being formed between the membrane 10 and casing base 11.

The base 11 has a circumferential wall having substantial thickness, so that the openings 13 form vibrating air columns. The space 12 and the sound-outlet openings 13 here form a Helmholtz resonator.

In the case of the exemplary embodiment of FIG. 1, the clamping ring 7 contains radially directed threaded blind bores 14 which open radially outward.

Stepped bores 15 which are coaxial with the threaded bores 14 are formed in the casing 1 and have small diameter sections 16 radially inside of large diameter sections 17.

Tensioning screws 18 are introduced into the stepped bores 15 from the outside in the radial direction and have their threaded stem screwed into the threaded bores 14 in the clamping 7.

The tensioning screws 18 have their screw heads 19 supported on the step between the large diameter sections 17 and the small diameter section 16. By virtue of the tensioning screws 18 being screwed further into the threaded bores 14, the clamping ring 7 is expanded radially outwards and the membrane 10 is thus subjected to radial stressing, so that its characteristic frequency is changed.

Figure 2:
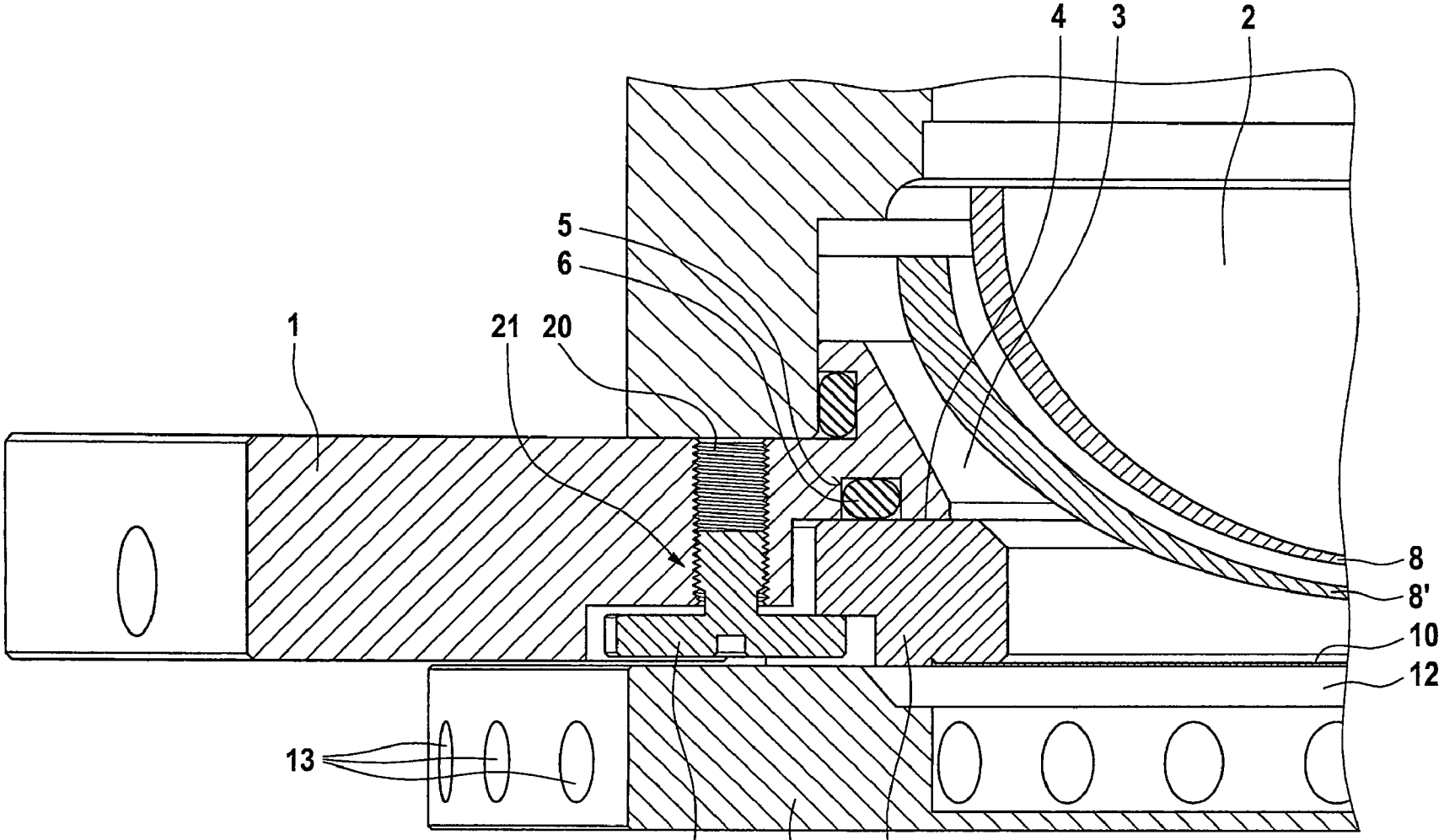
FIG. 2 shows a partial cross-sectional view of a second exemplary embodiment of a timepiece.

In the case of the exemplary embodiment of FIG. 2, the casing 1 has axial threaded bores 20 distributed uniformly around the periphery of the clamping ring 7'. The bores 20 receive clamping screws 21 which have part of their screw heads 22 radially overlapping the clamping ring 7'. By virtue of being screwed firmly into the threaded bores 20, the screw heads 22 press the clamping ring 7' firmly onto the annular surface 4, so that the clamping ring 7' is held firmly in this position.

If the clamping ring 7' is expanded radially, using a device which has not been illustrated, to the desired stressing of the membrane 10 and fixes this state by the clamping screws 21 on the annular surface 4, the membrane 10 achieves radial stressing with the desired characteristic frequency.

Figure 3:
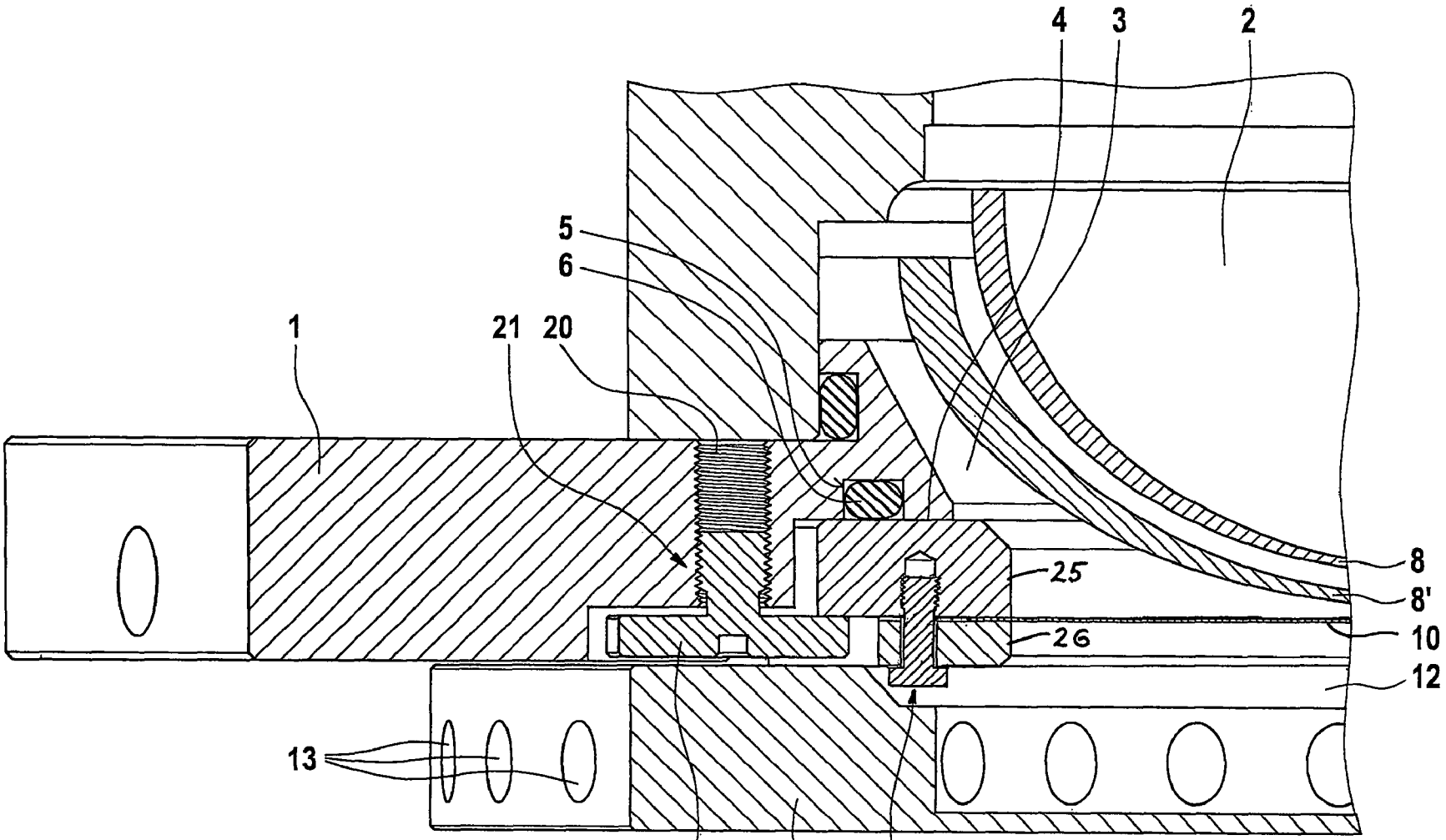
FIG. 3 shows an alternative clamping ring for the membrane.

FIG. 3 shows an alternative clamping ring consisting of a first part 25 having axially extending threaded blind bores, a second part 26 having holes which can be aligned with the blind bores, and screws 27 which fix the parts together to clamp the membrane 10 therebetween.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A timepiece comprising:

a casing comprising a casing interior having a viewer's side provided with a viewing opening, a base side provided with a sound aperture, and an annular surface surrounding the sound aperture;

a membrane extending over the sound aperture to close the base side of the casing interior, the membrane having a circumferential region in sealed connection with the annular surface;

a vibration generator arranged in the casing interior; and means for subjecting the circumferential region to a tensile loading in the radial direction.

2. The timepiece of claim 1 wherein the means for subjecting the circumferential region to a tensile loading comprises a clamping ring in sealed abutment with the annular surface, the circumferential region of the membrane being in sealed abutment with the clamping ring, the clamping ring being subject to tension in the radial direction.

3. The timepiece of claim 2 wherein the circumferential region of the membrane is fixed to the clamping ring by a non-releasable connection.

4. The timepiece of claim 2 wherein the membrane is connected to the clamping ring in a pre-tensioned state.

5. The timepiece of claim 2 wherein the membrane is connected to the clamping ring by laser welding.

6. The timepiece of claim 2 wherein the membrane is connected to the clamping ring by adhesive bonding.

7. The timepiece of claim 2 wherein the clamping ring comprises two parts which are connected together, the membrane being clamped between the two parts.

8. The timepiece of claim 7 wherein the two parts are clamped together axially by screws.

9. The timepiece of claim 2 wherein the annular surface is formed with a circular groove which receives a sealing ring, the clamping ring being received against the sealing ring.

10. The timepiece of claim 2 wherein the means for subjecting the circumferential region to a tensile loading further comprises:

axially extending threaded bores in the casing; and clamping screws screwed into the threaded bores, each clamping screw having a head bearing on the clamping ring.

11. The timepiece of claim 10 wherein the clamping screws are uniformly distributed around the clamping ring.

12. The timepiece of claim 2 wherein the means for subjecting the circumferential region to a tensile loading further comprises:

radially extending threaded bores in the clamping ring; and tensioning screws screwed into the threaded bores and supported on the casing against radial inward movement, whereby, the tensioning screws can be used to adjust the tension on the membrane in the radial direction.

13. The timepiece of claim 12 further comprising stepped bores in the casing, wherein said stepped bores are coaxial with respective said threaded bores in the clamping ring, each said stepped bore having a radially inward small diameter section, a radially outward large diameter section, and a step between said sections, each said tensioning screw having a head supported on a respective said step.

14. A timepiece comprising:

a casing comprising a casing interior having a viewer's side provided with a viewing opening, a base side provided with a sound aperture, and an annular surface surrounding the sound aperture;

a membrane extending over the sound aperture to close the base side of the casing interior, the membrane having a circumferential region in sealed connection with the annular surface;

a vibration generator arranged in the casing interior; and means for maintaining the membrane at a desired tension in the radial direction.

15. The timepiece of claim 1 further comprising a casing base fastened to the casing and forming a space between the membrane and the casing base, the casing base having openings which serve as sound outlets.

16. The timepiece of claim 15 wherein the openings extend radially from the space.

17. The timepiece of claim 1 wherein the space and the openings form a Helmholtz resonator.

18. The timepiece of claim 1 wherein the membrane is a metal membrane.

19. The timepiece of claim 1 wherein the membrane is one of gold and a gold alloy.

20. The timepiece of claim 1 wherein the vibration generator is one of a gong and a bell.

21. The timepiece of claim 20 wherein the vibration generator is one of niobium and a niobium alloy.

* * * * *